US008336742B2

(12) United States Patent
Greer, Jr. et al.

(10) Patent No.: US 8,336,742 B2
(45) **Date of Patent: *Dec. 25, 2012**

(54) AEROSOL SYSTEMS AND METHODS FOR DISPENSING TEXTURE MATERIAL

(75) Inventors: Lester R. Greer, Jr., Sandpoint, ID (US); Floyd R. French, Manchester, MO (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/280,924

(22) Filed: Oct. 25, 2011

(65) Prior Publication Data

US 2012/0097703 A1 Apr. 26, 2012

Related U.S. Application Data

(63) Continuation of application No. 12/859,195, filed on Aug. 18, 2010, now Pat. No. 8,042,713, which is a continuation of application No. 11/982,133, filed on Oct. 31, 2007, now abandoned, which is a continuation of application No. 11/413,659, filed on Apr. 27, 2006, now Pat. No. 7,487,893, which is a continuation-in-part of application No. 11/027,219, filed on Dec. 29, 2004, now Pat. No. 7,374,068.

(60) Provisional application No. 60/675,697, filed on Apr. 27, 2005, provisional application No. 60/617,236, filed on Oct. 8, 2004.

(51) Int. Cl.
*B65D 83/00* (2006.01)

(52) U.S. Cl. ..... 222/402.1; 222/1; 222/394; 239/337

(58) Field of Classification Search ..... 222/1, 402.1, 222/394, 402.18, 402.21, 402.22, 402.23, 222/402.24, 402.25; 239/337, 340, 592, 239/597

See application file for complete search history.

(56) References Cited

U.S. PATENT DOCUMENTS 208,330 A 9/1878 Palmer (Continued)

FOREIGN PATENT DOCUMENTS

CA 770467 10/1967

(Continued)

OTHER PUBLICATIONS

Homax Products, Inc., "Easy Touch Spray Texture Brochure", Mar. 1992, 1 page.

(Continued)

*Primary Examiner* — Frederick C. Nicolas

(74) *Attorney, Agent, or Firm* — Michael R. Schacht; Schacht Law Office, Inc.

(57) ABSTRACT

Aerosol material for applying a repair coat to an uncoated portion of a substrate substantially to match a coated portion of the substrate using an aerosol assembly comprises a container defining a product chamber and a valve assembly operable in open and closed modes, the aerosol material comprises a base portion, a particulate portion, and a propellant portion. The particulate portion is made of at least one of urethane foam and melamine foam. With the valve assembly in the open mode, the propellant portion in the gas state gas state forces at least part of the base portion, the particulate portion, and the propellant portion in the liquid state out of the product chamber and onto the uncoated portion of the substrate to form the repair coat such that the repair coat substantially matches the coated portion of the substrate.

15 Claims, 6 Drawing Sheets

U.S. PATENT DOCUMENTS

| | | | |
|---|---|---|---|
| 351,968 | A | 11/1886 | Derrick |
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 604,151 | A | 5/1898 | Horn |
| 625,594 | A | 5/1899 | Oldham |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,162,170 | A | 11/1915 | Johnson |
| 1,294,190 | A | 2/1919 | Sturcke |
| 1,332,544 | A | 3/1920 | Davis |
| 1,486,156 | A | 3/1924 | Needham |
| 1,609,465 | A | 12/1926 | Day |
| 1,643,969 | A | 10/1927 | Tittemore et al. |
| 1,650,686 | A | 11/1927 | Binks |
| 1,656,132 | A | 1/1928 | Arrasmith et al. |
| 1,674,510 | A | 6/1928 | Hagman |
| 1,755,329 | A | 4/1930 | McCormack |
| 1,770,011 | A | 7/1930 | Poston |
| 1,809,073 | A | 6/1931 | Schylander |
| 1,863,924 | A | 6/1932 | Dunn |
| 1,988,017 | A | 1/1935 | Norwick |
| 2,127,188 | A | 8/1938 | Schellin et al. |
| 2,149,930 | A | 3/1939 | Plastaras |
| 2,197,052 | A | 4/1940 | Lowen |
| 2,198,271 | A | 4/1940 | McCallum |
| D134,562 | S | 12/1942 | Murphy |
| 2,305,269 | A | 12/1942 | Moreland |
| 2,307,014 | A | 1/1943 | Becker et al. |
| 2,320,964 | A | 6/1943 | Yates |
| 2,353,318 | A | 7/1944 | Scheller |
| 2,361,407 | A | 10/1944 | McNair |
| 2,530,808 | A | 11/1950 | Cerasi |
| 2,565,954 | A | 8/1951 | Dey |
| 2,686,652 | A | 8/1954 | Carlson et al. |
| 2,704,690 | A | 3/1955 | Eichenauer |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,801,880 | A | 8/1957 | Rienecker |
| 2,831,618 | A | 4/1958 | Soffer et al. |
| 2,839,225 | A | 6/1958 | Soffer et al. |
| 2,887,274 | A | 5/1959 | Swenson |
| 2,908,446 | A | 10/1959 | Strouse |
| 2,923,481 | A | 2/1960 | Pinke |
| 2,932,434 | A | 4/1960 | Abplanalp |
| 2,962,743 | A | 12/1960 | Henriksson |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 2,999,646 | A | 9/1961 | Wagner |
| 3,016,561 | A | 1/1962 | Hulsh |
| 2,032,803 | A | 5/1962 | Walshauser |
| 3,072,953 | A | 1/1963 | Bunke |
| 3,083,872 | A | 4/1963 | Meshberg |
| 3,107,059 | A | 10/1963 | Frechette |
| 3,116,856 | A | 1/1964 | Prussin et al. |
| 3,116,879 | A | 1/1964 | Wagner |
| 3,121,906 | A | 2/1964 | Hulsh |
| 3,135,007 | A | 6/1964 | Howell |
| 3,148,806 | A | 9/1964 | Meshberg |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,207,444 | A | 9/1965 | Kelley et al. |
| 3,216,628 | A | 11/1965 | Fergusson |
| 3,236,459 | A | 2/1966 | McRitchie |
| 3,246,850 | A | 4/1966 | Bourke |
| 3,258,208 | A | 6/1966 | Greenebaum, II |
| 3,271,810 | A | 9/1966 | Raffe |
| 3,284,007 | A | 11/1966 | Clapp |
| 3,305,144 | A | 2/1967 | Beres et al. |
| 3,307,788 | A | 3/1967 | Ingram |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford et al. |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,445,068 | A | 5/1969 | Wagner |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,491,951 | A | 1/1970 | Knibb |
| 3,503,882 | A | 3/1970 | Fitch |
| 3,514,042 | A | 5/1970 | Freed |
| 3,544,258 | A | 12/1970 | Presant et al. |
| 3,548,564 | A | 12/1970 | Bruce et al. |
| 3,575,319 | A | 4/1971 | Safianoff |
| 3,592,359 | A | 7/1971 | Marraffino |
| 3,596,835 | A | 8/1971 | Smith |
| 3,613,954 | A | 10/1971 | Bayne |
| 3,647,143 | A | 3/1972 | Gauthier et al. |
| 3,648,932 | A | 3/1972 | Ewald et al. |
| 3,680,789 | A | 8/1972 | Wagner |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,756,732 | A | 9/1973 | Stoffler |
| 3,764,067 | A | 10/1973 | Coffey et al. |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,788,526 | A | 1/1974 | Thornton et al. |
| 3,795,366 | A | 3/1974 | McGhie et al. |
| 3,797,946 | A | 3/1974 | Witzmann et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,876,154 | A | 4/1975 | Griebel |
| 3,891,128 | A | 6/1975 | Smrt |
| 3,899,134 | A | 8/1975 | Wagner |
| 3,912,132 | A | 10/1975 | Stevens |
| 3,913,804 | A | 10/1975 | Laauwe |
| 3,913,842 | A | 10/1975 | Singer |
| D237,796 | S | 11/1975 | Wagner |
| 3,936,002 | A | 2/1976 | Geberth, Jr. |
| 3,938,708 | A | 2/1976 | Burger |
| 3,945,571 | A | 3/1976 | Rash |
| 3,975,554 | A | 8/1976 | Kummins et al. |
| 3,982,698 | A | 9/1976 | Anderson |
| 3,987,811 | A | 10/1976 | Finger |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,438 | A | 7/1977 | Soderlind et al. |
| 4,036,673 | A | 7/1977 | Murphy et al. |
| 4,045,860 | A | 9/1977 | Winckler |

4,058,287 A 11/1977 Fromfield
4,078,578 A 3/1978 Buchholz
4,089,443 A 5/1978 Zrinyi
4,096,974 A 6/1978 Haber et al.
4,117,951 A 10/1978 Winckler
4,123,005 A 10/1978 Blunk
4,147,284 A 4/1979 Mizzi
4,148,416 A 4/1979 Gunn-Smith
4,154,378 A 5/1979 Paoletti et al.
4,159,079 A 6/1979 Phillips, Jr.
4,164,492 A 8/1979 Cooper
RE30,093 E 9/1979 Burger
4,171,757 A 10/1979 Diamond
4,185,758 A 1/1980 Giggard
4,187,959 A 2/1980 Pelton
4,187,985 A 2/1980 Goth
4,195,780 A 4/1980 Inglis
4,197,357 A 4/1980 Huisman
4,198,365 A 4/1980 Pelton
4,204,645 A 5/1980 Hopp
4,229,312 A 10/1980 Nagashiro et al.
4,238,264 A 12/1980 Pelton
4,275,172 A 6/1981 Barth et al.
4,293,353 A 10/1981 Pelton et al.
4,308,973 A 1/1982 Irland
4,310,108 A 1/1982 Motoyama et al.
4,322,020 A 3/1982 Stone
4,346,743 A 8/1982 Miller
4,354,638 A 10/1982 Weinstein
4,358,388 A 11/1982 Daniel et al.
4,364,521 A 12/1982 Stankowitz
4,370,930 A 2/1983 Strasser et al.
4,401,271 A 8/1983 Hansen
4,401,272 A 8/1983 Merton et al.
4,411,387 A 10/1983 Stern et al.
4,412,929 A 11/1983 Lysenko et al.
4,417,674 A 11/1983 Giuffredi
4,434,939 A 3/1984 Stankowitz
4,438,221 A 3/1984 Fracalossi et al.
4,438,884 A 3/1984 O'Brien et al.
4,442,959 A 4/1984 Del Bon et al.
4,460,719 A 7/1984 Danville
4,493,778 A 1/1985 Iqbal
4,496,081 A 1/1985 Farrey
4,546,905 A 10/1985 Nandagiri et al.
4,609,608 A 9/1986 Solc
4,620,669 A 11/1986 Polk
4,641,765 A 2/1987 Diamond
4,674,903 A 6/1987 Chen
4,683,246 A 7/1987 Davis et al.
4,685,622 A 8/1987 Shimohira et al.
4,728,007 A 3/1988 Samuelson et al.
4,744,516 A 5/1988 Peterson et al.
4,761,312 A 8/1988 Koshi et al.
4,793,162 A 12/1988 Emmons
4,804,144 A 2/1989 Denman
4,815,414 A 3/1989 Duffy et al.
4,818,781 A 4/1989 Yamakawa et al.
4,819,838 A 4/1989 Hart, Jr.
4,830,224 A 5/1989 Brison
4,839,393 A 6/1989 Buchanan et al.
4,850,387 A 7/1989 Bassill
4,854,482 A 8/1989 Bergner
4,863,104 A 9/1989 Masterson
4,870,805 A 10/1989 Morane
4,878,599 A 11/1989 Greenway
4,887,651 A 12/1989 Santiago
4,893,730 A 1/1990 Bolduc
4,896,832 A 1/1990 Howlett
D307,649 S 5/1990 Henry
4,940,171 A 7/1990 Gilroy
4,948,054 A 8/1990 Mills
4,949,871 A 8/1990 Flanner
4,951,876 A 8/1990 Mills
4,954,544 A 9/1990 Chandaria
4,955,545 A 9/1990 Stern et al.
4,961,537 A 10/1990 Stern
4,969,577 A 11/1990 Werding
4,969,579 A 11/1990 Behar
4,988,017 A 1/1991 Schrader et al.
4,989,787 A 2/1991 Nikkel et al.
4,991,750 A 2/1991 Moral
5,007,556 A 4/1991 Lover
5,009,390 A 4/1991 McAuliffe, Jr. et al.
5,028,497 A 7/1991 Somezawa et al.
5,037,011 A 8/1991 Woods
5,038,964 A 8/1991 Bouix
5,039,017 A 8/1991 Howe
5,052,585 A 10/1991 Bolduc
5,059,187 A 10/1991 Sperry et al.
5,065,900 A 11/1991 Scheindel
5,069,390 A 12/1991 Stern et al.
5,100,055 A 3/1992 Rokitenetz et al.
5,115,944 A 5/1992 Nikolich
5,126,086 A 6/1992 Stoffel
5,150,880 A 9/1992 Austin, Jr. et al.
5,169,037 A 12/1992 Davies et al.
5,182,316 A 1/1993 DeVoe et al.
5,188,263 A 2/1993 Woods
5,188,295 A 2/1993 Stern et al.
5,211,317 A 5/1993 Diamond et al.
5,232,161 A 8/1993 Clemmons
5,255,846 A 10/1993 Ortega
5,288,024 A 2/1994 Vitale
5,297,704 A 3/1994 Stollmeyer
5,307,964 A 5/1994 Toth
5,310,095 A 5/1994 Stern et al.
5,312,888 A 5/1994 Nafziger et al.
5,314,097 A 5/1994 Smrt et al.
5,323,963 A 6/1994 Ballu
5,341,970 A 8/1994 Woods
5,368,207 A 11/1994 Cruysberghs
5,405,051 A 4/1995 Miskell
5,409,148 A 4/1995 Stern et al.
5,415,351 A 5/1995 Otto et al.
5,417,357 A 5/1995 Yquel
D358,989 S 6/1995 Woods
5,421,519 A 6/1995 Woods
5,425,824 A 6/1995 Marwick
5,443,211 A 8/1995 Young et al.
5,450,983 A 9/1995 Stern et al.
5,467,902 A 11/1995 Yquel
5,476,879 A 12/1995 Woods et al.
5,489,048 A 2/1996 Stern et al.
5,498,282 A 3/1996 Miller et al.
5,501,375 A 3/1996 Nilson
5,505,344 A 4/1996 Woods
5,523,798 A 6/1996 Hagino et al.
5,524,798 A 6/1996 Stern et al.
5,544,783 A 8/1996 Conigliaro
5,548,010 A 8/1996 Franer
5,549,228 A 8/1996 Brown
5,558,247 A 9/1996 Caso
5,562,235 A 10/1996 Cruysberghs
5,570,813 A 11/1996 Clark, II
5,573,137 A 11/1996 Pauls
5,577,851 A 11/1996 Koptis
5,583,178 A 12/1996 Oxman et al.
5,597,095 A 1/1997 Ferrara, Jr.
5,638,990 A 6/1997 Kastberg
5,639,026 A 6/1997 Woods
5,641,095 A 6/1997 de Laforcade
5,645,198 A 7/1997 Stern et al.
5,655,691 A 8/1997 Stern et al.
5,695,788 A 12/1997 Woods
5,715,975 A 2/1998 Stern et al.
5,727,736 A 3/1998 Tryon
5,752,631 A 5/1998 Yabuno et al.
5,799,879 A 9/1998 Ottl et al.
5,865,351 A 2/1999 De Laforcade
5,894,964 A 4/1999 Barnes et al.
5,915,598 A 6/1999 Yazawa et al.
5,921,446 A 7/1999 Stern
5,934,518 A 8/1999 Stern et al.
5,941,462 A 8/1999 Sandor
5,957,333 A 9/1999 Losenno et al.
5,975,356 A 11/1999 Yquel et al.
5,979,797 A 11/1999 Castellano 5,988,575 A 11/1999 Lesko
5,988,923 A 11/1999 Arai
6,000,583 A 12/1999 Stern et al.
6,027,042 A 2/2000 Smith
6,032,830 A 3/2000 Brown
6,039,306 A 3/2000 Pericard et al.
6,070,770 A 6/2000 Tada et al.
6,092,698 A 7/2000 Bayer
6,095,435 A 8/2000 Greer, Jr. et al.
6,112,945 A 9/2000 Woods
6,113,070 A 9/2000 Holzboog
6,116,473 A 9/2000 Stern et al.
6,129,247 A 10/2000 Thomas et al.
6,131,777 A 10/2000 Warby
6,152,335 A 11/2000 Stern et al.
6,161,735 A 12/2000 Uchiyama et al.
6,168,093 B1 1/2001 Greer, Jr. et al.
6,170,717 B1 1/2001 Di Giovanni et al.
D438,111 S 2/2001 Woods
6,225,393 B1 5/2001 Woods
6,254,015 B1 7/2001 Abplanalp
6,257,503 B1 7/2001 Baudin
6,261,631 B1 7/2001 Lomasney et al.
6,265,459 B1 7/2001 Mahoney et al.
6,276,570 B1 8/2001 Stern et al.
6,283,171 B1 9/2001 Blake
6,290,104 B1 9/2001 Bougamont et al.
6,296,155 B1 10/2001 Smith
6,299,679 B1 10/2001 Montoya
6,299,686 B1 10/2001 Mills
6,315,152 B1 11/2001 Kalisz
6,325,256 B1 12/2001 Liljeqvist et al.
6,328,185 B1 12/2001 Stern et al.
6,334,727 B1 1/2002 Gueret
6,352,184 B1 3/2002 Stern et al.
6,362,302 B1 3/2002 Boddie
6,375,036 B1 4/2002 Woods
6,382,474 B1 5/2002 Woods et al.
6,386,402 B1 5/2002 Woods
6,394,321 B1 5/2002 Bayer
6,394,364 B1 5/2002 Abplanalp
6,395,794 B2 5/2002 Lucas et al.
6,398,082 B2 6/2002 Clark et al.
6,399,687 B2 6/2002 Woods
6,415,964 B2 7/2002 Woods
6,439,430 B1 8/2002 Gilroy, Sr. et al.
6,446,842 B2 9/2002 Stern et al.
6,474,513 B2 11/2002 Burt
6,478,198 B2 11/2002 Haroian
6,478,561 B2 11/2002 Braun et al.
D468,980 S 1/2003 Woods
6,510,969 B2 1/2003 Di Giovanni et al.
6,531,528 B1 3/2003 Kurp
6,536,633 B2 3/2003 Stern et al.
6,581,807 B1 6/2003 Mekata
6,588,628 B2 7/2003 Abplanalp et al.
6,595,393 B1 7/2003 Loghman-Adham et al.
6,615,827 B2 9/2003 Greenwood et al.
6,637,627 B1 10/2003 Liljeqvist et al.
6,641,005 B1 * 11/2003 Stern et al. ..... 222/402.1
6,641,864 B2 11/2003 Woods
6,652,704 B2 11/2003 Green
6,659,312 B1 * 12/2003 Stern et al. ..... 222/402.1
6,666,352 B1 * 12/2003 Woods ..... 222/1
6,688,492 B2 2/2004 Jaworski et al.
6,712,238 B1 3/2004 Mills
6,726,066 B2 4/2004 Woods
6,736,288 B1 5/2004 Green
6,758,373 B2 7/2004 Jackson et al.
6,797,051 B2 9/2004 Woods
6,802,461 B2 10/2004 Schneider
6,832,704 B2 12/2004 Smith
6,837,396 B2 1/2005 Jaworski et al.
6,843,392 B1 1/2005 Walker
6,848,601 B2 2/2005 Greer, Jr.
6,851,575 B2 2/2005 van't Hoff
6,880,733 B2 4/2005 Park
6,883,688 B1 4/2005 Stern et al.
6,905,050 B1 6/2005 Stern et al.
6,910,608 B2 6/2005 Greer, Jr. et al.
6,913,407 B2 7/2005 Greer et al.
6,926,178 B1 8/2005 Anderson
6,932,244 B2 8/2005 Meshberg
6,966,467 B2 11/2005 Di Giovanni et al.
6,978,916 B2 12/2005 Smith
6,978,947 B2 12/2005 Jin
6,981,616 B2 1/2006 Loghman-Adham et al.
7,014,073 B1 * 3/2006 Stern et al. ..... 222/402.1
7,014,127 B2 3/2006 Valpey, III et al.
7,036,685 B1 5/2006 Green
7,059,497 B2 6/2006 Woods
7,059,546 B2 6/2006 Ogata et al.
7,063,236 B2 6/2006 Greer, Jr. et al.
7,104,424 B2 9/2006 Kolanus
7,104,427 B2 9/2006 Pericard et al.
7,121,434 B1 10/2006 Caruso
7,163,962 B2 1/2007 Woods
7,182,227 B2 2/2007 Poile et al.
7,189,022 B1 3/2007 Greer, Jr. et al.
7,192,985 B2 * 3/2007 Woods ..... 516/11
7,204,393 B2 4/2007 Strand
7,226,001 B1 6/2007 Stern et al.
7,226,232 B2 6/2007 Greer, Jr. et al.
7,232,047 B2 6/2007 Greer, Jr. et al.
7,237,697 B2 7/2007 Dunne
7,240,857 B1 7/2007 Stern et al.
7,249,692 B2 7/2007 Walters et al.
7,261,225 B2 8/2007 Rueschhoff et al.
7,267,248 B2 9/2007 Yerby et al.
7,278,590 B1 10/2007 Greer, Jr. et al.
7,303,152 B2 12/2007 Woods
7,337,985 B1 3/2008 Greer, Jr. et al.
7,341,169 B2 3/2008 Bayer
7,350,676 B2 4/2008 di Giovanni et al.
7,374,068 B2 5/2008 Greer, Jr.
7,383,968 B2 6/2008 Greer, Jr. et al.
7,383,970 B2 6/2008 Anderson
7,448,517 B2 11/2008 Shieh et al.
7,481,338 B1 1/2009 Stern et al.
7,487,891 B2 2/2009 Yerby et al.
7,487,893 B1 * 2/2009 Greer et al. ..... 222/402.1
7,494,075 B2 2/2009 Schneider
7,500,621 B2 3/2009 Tryon et al.
7,510,102 B2 3/2009 Schmitt
7,588,171 B2 9/2009 Reedy et al.
7,597,274 B1 10/2009 Stern et al.
7,600,659 B1 10/2009 Greer, Jr. et al.
7,624,932 B1 12/2009 Greer, Jr. et al.
7,631,785 B2 12/2009 Paas et al.
7,641,079 B2 1/2010 Lott et al.
7,673,816 B1 3/2010 Stern et al.
7,677,420 B1 * 3/2010 Greer et al. ..... 222/402.1
7,699,190 B2 4/2010 Hygema
7,721,920 B2 5/2010 Ruiz De Gopegui et al.
7,744,299 B1 6/2010 Greer, Jr. et al.
7,748,572 B2 7/2010 Althoff et al.
7,757,905 B2 7/2010 Strand et al.
7,766,196 B2 8/2010 Sugano et al.
7,775,408 B2 8/2010 Yamamoto et al.
7,784,647 B2 8/2010 Tourigny
7,784,649 B2 * 8/2010 Greer, Jr. ..... 222/402.1
7,789,278 B2 9/2010 Ruiz de Gopegui et al.
7,845,523 B1 12/2010 Greer, Jr. et al.
7,854,356 B2 12/2010 Eberhardt
7,886,995 B2 2/2011 Togashi
7,891,529 B2 2/2011 Paas et al.
7,913,877 B2 3/2011 Neuhalfen
7,922,041 B2 4/2011 Gurrisi et al.
7,926,741 B2 4/2011 Laidler et al.
7,947,753 B2 5/2011 Greer, Jr.
7,980,487 B2 7/2011 Mirazita et al.
7,984,827 B2 7/2011 Hygema
7,984,834 B2 7/2011 McBroom et al.
7,997,511 B2 8/2011 Reynolds et al.
8,006,868 B2 8/2011 Geiberger et al.
8,016,163 B2 9/2011 Behar et al.
8,025,189 B2 9/2011 Salameh
8,028,861 B2 10/2011 Brouwer

| | | | | |
|---|---|---|---|---|
| 8,028,864 | B2 | 10/2011 | Stern et al. | |
| 8,033,432 | B2 | 10/2011 | Pardonge et al. | |
| 8,033,484 | B2 | 10/2011 | Tryon et al. | |
| 8,038,077 | B1 | 10/2011 | Greer, Jr. et al. | |
| 8,042,713 | B2 * | 10/2011 | Greer et al. | 222/402.1 |
| 8,070,017 | B2 | 12/2011 | Green | |
| 8,074,847 | B2 | 12/2011 | Smith | |
| 8,074,848 | B2 | 12/2011 | Pittl et al. | |
| 8,083,159 | B2 | 12/2011 | Leuliet et al. | |
| 8,087,548 | B2 | 1/2012 | Kimball | |
| 8,087,552 | B2 | 1/2012 | Fazekas et al. | |
| 2001/0002676 | A1 | 6/2001 | Woods | |
| 2002/0003147 | A1 | 1/2002 | Corba | |
| 2002/0100769 | A1 | 8/2002 | McKune | |
| 2002/0119256 | A1 | 8/2002 | Woods | |
| 2003/0102328 | A1 | 6/2003 | Abplanalp et al. | |
| 2003/0205580 | A1 | 11/2003 | Yahav | |
| 2004/0012622 | A1 | 1/2004 | Russo et al. | |
| 2004/0099697 | A1 | 5/2004 | Woods | |
| 2004/0195277 | A1 | 10/2004 | Woods | |
| 2005/0121474 | A1 | 6/2005 | Lasserre et al. | |
| 2005/0161531 | A1 | 7/2005 | Greer, Jr. et al. | |
| 2005/0236436 | A1 | 10/2005 | Woods | |
| 2006/0049205 | A1 | 3/2006 | Green | |
| 2006/0180616 | A1 | 8/2006 | Woods | |
| 2006/0219808 | A1 | 10/2006 | Woods | |
| 2006/0219811 | A1 | 10/2006 | Woods | |
| 2006/0273207 | A1 | 12/2006 | Woods | |
| 2007/0119984 | A1 | 5/2007 | Woods | |
| 2007/0219310 | A1 | 9/2007 | Woods | |
| 2007/0228086 | A1 | 10/2007 | Delande et al. | |
| 2007/0235563 | A1 | 10/2007 | Woods | |
| 2007/0260011 | A1 | 11/2007 | Woods | |
| 2008/0017671 | A1 | 1/2008 | Shieh et al. | |
| 2008/0029551 | A1 | 2/2008 | Lombardi | |
| 2008/0041887 | A1 | 2/2008 | Scheindel | |
| 2008/0164347 | A1 | 7/2008 | Leuliet et al. | |
| 2009/0020621 | A1 | 1/2009 | Clark et al. | |
| 2009/0283545 | A1 | 11/2009 | Kimball | |
| 2010/0108716 | A1 | 5/2010 | Bilko | |
| 2010/0155432 | A1 | 6/2010 | Christianson | |
| 2010/0200612 | A1 | 8/2010 | Smith | |
| 2010/0322892 | A1 | 12/2010 | Burke | |
| 2011/0101025 | A1 | 5/2011 | Walters et al. | |
| 2011/0127300 | A1 | 6/2011 | Ghavami-Nasr et al. | |
| 2011/0210141 | A1 | 9/2011 | Maas et al. | |
| 2011/0210184 | A1 | 9/2011 | Maas et al. | |
| 2011/0215119 | A1 | 9/2011 | McBroom | |
| 2011/0218096 | A1 | 9/2011 | Hatanaka et al. | |
| 2011/0220685 | A1 | 9/2011 | Lind et al. | |
| 2011/0233235 | A1 | 9/2011 | Adams et al. | |
| 2011/0240682 | A1 | 10/2011 | Miyamoto et al. | |
| 2011/0240771 | A1 | 10/2011 | Legeza | |
| 2011/0253749 | A1 | 10/2011 | Hygema | |
| 2011/0266310 | A1 | 11/2011 | Tomkins et al. | |
| 2011/0281030 | A1 | 11/2011 | Greer, Jr. | |
| 2012/0006858 | A1 | 1/2012 | Rovelli | |
| 2012/0006859 | A1 | 1/2012 | Wilkinson et al. | |
| 2012/0064249 | A1 | 3/2012 | Greer, Jr. | |

FOREIGN PATENT DOCUMENTS

| | | |
|---|---|---|
| CA | 976125 | 10/1975 |
| CA | 1210371 | 8/1986 |
| CA | 2145129 | 9/1995 |
| CA | 2090185 | 10/1998 |
| CA | 2224042 | 6/1999 |
| CA | 2291599 | 6/2000 |
| CA | 2381994 | 2/2001 |
| CA | 2065534 | 8/2003 |
| CA | 22448794 | 5/2004 |
| CA | 2504509 | 10/2005 |
| CA | 2504513 | 10/2005 |
| CH | 680849 | 11/1992 |
| DE | 210449 | 2/1907 |
| DE | 250831 | 9/1912 |
| DE | 634230 | 8/1936 |
| DE | 1926796 | 3/1970 |
| DE | 3808438 | 4/1989 |
| DE | 3806991 | 9/1989 |
| FR | 463476 | 2/1914 |
| FR | 1354522 | 9/1965 |
| FR | 1586067 | 2/1970 |
| FR | 2336186 | 7/1977 |
| FR | 2659847 | 9/1991 |
| GB | 470488 | 11/1935 |
| GB | 491396 | 9/1938 |
| GB | 494134 | 10/1938 |
| GB | 508734 | 7/1939 |
| GB | 534349 | 3/1941 |
| GB | 675664 | 7/1952 |
| GB | 726455 | 3/1955 |
| GB | 867713 | 5/1961 |
| GB | 977860 | 12/1964 |
| GB | 1144385 | 3/1969 |
| GB | 2418959 | 12/2006 |
| JP | 461392 | 1/1971 |
| JP | 8332414 | 12/1996 |
| WO | 8904796 | 6/1989 |

OTHER PUBLICATIONS

Newman-Green, Inc., "Aerosol Valves, Sprayheads & Accessories Catalog", Apr. 1, 1992, pp. 14, 20, and 22.

USPTO, Office Action U.S. Appl. No. 11/982,133, Jan. 28, 2009, 6 pages.

Schacht Law Office, Inc., Response to Jan. 28, 2009 Office Action, Feb. 27, 2009, 2 pages.

USPTO, Office Action U.S. Appl. No. 11/982,133, Mar. 27, 2009, 12 pages.

Schacht Law Office, Inc., Response to Mar. 27, 2009 Office Action, Jul. 27, 2009, 9 pages.

USPTO, Office Action U.S. Appl. No. 11/982,133, Nov. 30, 2009, 4 pages.

Schacht Law Office, Inc., Response to Nov. 30, 2009 Office Action, Mar. 1, 2010, 10 pages.

USPTO, Office Action U.S. Appl. No. 11/982,133, May 18, 2010, 7 pages.

USPTO, Office Action U.S. Appl. No. 12/859,195, Jan. 20, 2011, 6 pages.

Schacht Law Office, Inc., Response to Jan. 20, 2011 Office Action, Apr. 20, 2011, 10 pages.

USPTO, Notice of Allowance U.S. Appl. No. 12/859,195, Jul. 15, 2011, 20 pages.

USPTO, Office Action U.S. Appl. No. 13/280,924, Mar. 26, 2012, 6 pages.

USPTO, Office Action U.S. Appl. No. 11/413,659, May 29, 2007, 12 pages.

Schacht Law Office, Inc., Response to May 29, 2007 Office Action, Aug. 29, 2007, 16 pages.

USPTO, Office Action U.S. Appl. No. 11/413,659, Nov. 15, 2007, 5 pages.

Schacht Law Office, Inc., Response to Nov. 15, 2007 Office Action, Feb. 15, 2008, 8 pages.

USPTO, Office Action U.S. Appl. No. 11/413,659, Mar. 17, 2008, 7 pages.

Schacht Law Office, Inc., Response to Mar. 17, 2008 Office Action, Jun. 17, 2008, 9 pages.

USPTO, Notice of Allowance U.S. Appl. No. 11/413,659, Sep. 30, 2008, 8 pages.

DAP Inc., DAP Patch Stick Product, 1994, 1 page.

* cited by examiner

AEROSOL SYSTEMS AND METHODS FOR DISPENSING TEXTURE MATERIAL

RELATED APPLICATIONS

This U.S. patent application Ser. No. 13/280,924 filed on Oct. 25, 2011 is a continuation of U.S. patent application Ser. No. 12/859,195 filed on Aug. 18, 2010, now U.S. Pat. No. 8,042,713, which issued on Oct. 25, 2011.

U.S. patent application Ser. No. 12/859,195 is a continuation of U.S. patent application Ser. No. 11/982,133 filed on Oct. 31, 2007, now abandoned.

U.S. patent application Ser. No. 11/982,133 is a continuation of U.S. patent application Ser. No. 11/413,659 filed on Apr. 27, 2006, now U.S. Pat. No. 7,487,893, which issued on Feb. 10, 2009.

U.S. patent application Ser. No. 11/413,659 claims benefit of U.S. Provisional Patent Application Ser. No. 60/675,697 filed on Apr. 27, 2005.

U.S. patent application Ser. No. 11/982,133 is also a continuation-in-part of U.S. patent application Ser. No. 11/027,219 filed on Dec. 29, 2004, now U.S. Pat. No. 7,374,068, which issued on May 20, 2008.

U.S. patent application Ser. No. 11/027,219 claims benefit of U.S. Provisional Patent Application Ser. No. 60/617,236 filed on Oct. 8, 2004.

The contents of all related applications listed above are incorporated herein by reference.

TECHNICAL FIELD

The present invention relates to the art of repairing a textured surface and, more particularly, to dispensing systems and methods for depositing texture materials, such as acoustic texture material and stucco material, onto a portion of a textured surface to be repaired.

BACKGROUND

In some situations, a separate texture layer is applied to an interior or external surface, often prior to painting. The texture layer is typically formed by spraying texture material onto the surface. Texture material is a coating material that, when sprayed, does not form a smooth, thin coating. Instead, texture material is applied in or contains discrete drops, globs, or particles that dry to form a bumpy, irregular textured surface.

Texture materials can be applied using any one of a number of application systems. During new construction, texture materials are commonly applied in a stream of compressed air using commercial hopper gun systems. For touch up or repair, texture material is commonly applied using hand operated pneumatic pumps or aerosol dispensing systems. Varying the parameters of the application system varies the size and spacing of the bumps to vary the look of the textured surface.

One specific form of texture material is commonly referred to as "acoustic" or "popcorn" texture material. In addition to a coating material, acoustic texture material further comprises an aggregate material. When the acoustic texture material is applied using commercial hopper guns, the aggregate material is conventionally formed by polystyrene chips. However, as will be described in detail below, chips made of polystyrene foam are dissolved by hydrocarbon aerosol propellant materials.

Accordingly, aerosol dispensing systems for dispensing small amounts of acoustic texture material for repair or touch-up purposes use one of two approaches. The first approach is to mix a liquid hydrocarbon aerosol propellant material with chips made from materials other than polystyrene. However, when chips made of materials other than polystyrene foam are used, the appearance and function of the texture surface may be different from that of the surrounding surface.

The second approach is to combine polystyrene chips with a propellant material formed by a pressurized inert gas such as nitrogen or air. This second approach allows the use of a conventional acoustic texture material including polystyrene chips. However, the use of a pressurized inert gas causes the acoustic texture material to be dispensed very quickly. The use of pressurized inert gas as a propellant can make it difficult for a non-professional to control the application of the acoustic texture material.

A second form of texture material is commonly referred to as "stucco." Conventionally, stucco is a plaster material made of Portland cement, sand, and lime. Conventional stucco is applied while soft to vertical walls or surfaces and then allowed to dry to form a decorative and protective coating. More recently, stucco surfaces have been formed using synthetic materials designed to resemble traditional stucco. Synthetic stucco is formed by acrylic polymers that, when dry, are flexible and water impervious. The term "stucco" will be used herein to refer both to traditional cement-based materials and to synthetic materials that resemble the traditional material.

Stucco material can be damaged and should be repaired for both structural and aesthetic reasons. Non-professionals typically do not have the tools or materials to repair a damage stucco surface to match the look of the original stucco surface surrounding the patch.

The need thus exists for systems and methods for dispensing texture materials, such as acoustic texture materials and stucco materials, that facilitate the repair by non-professionals of damaged surfaces to match the original texture material surrounding the patched area.

RELATED ART

Various aerosol devices for spraying a coating material onto a wall surface, ceiling, or the like are known. Depending upon the composition of the coating material, and other factors, the coating material can be sprayed onto the surface in a variety of texture patterns.

In some instances, a somewhat roughened texture is achieved by utilizing a textured composition that forms into droplets when it is dispensed, with the material then hardening with these droplets providing the textured surface. In other instances, solid particulate material is mixed with the liquid texture material so that with the particulate material being deposited with the hardenable liquid material on the wall surface, these particles provide the textured surface.

In particular, the Applicants are aware of prior art spray texture devices using an aerosol container which contains the texture material mixed with a propellant under pressure and from which the textured material is discharged onto a surface. Such aerosol dispensers are commonly used when there is a relatively small surface area to be covered with the spray texture material. Two such spray texture devices are disclosed in U.S. Pat. No. 5,037,011, issued Aug. 6, 1991, and more recently U.S. Pat. No. 5,188,263, issued Feb. 23, 1993 with John R. Woods being named inventor of both of these patents.

Additionally, the Assignee of the present invention has since approximately 1983 manufactured and sold manually operated devices for applying spray texture material onto walls and ceilings. These spray texture devices are described in one or more of the following U.S. Pat. Nos. 4,411,387; 4,955,545; 5,069,390; 5,188,295. These spray texture devices comprised a hopper containing hardenable material, a manually operated pump, and a nozzle. By pointing the device at the area being patched and operating the manual pump, the hardenable material and pressurized air generated by the pump were mixed in the nozzle and subsequently sprayed onto the area being patched.

SUMMARY

The present invention may be embodied as aerosol material for applying a repair coat to an uncoated portion of a substrate substantially to match a coated portion of the substrate using an aerosol assembly comprising a container defining a product chamber and a valve assembly operable in open and closed modes, the aerosol material comprising a base portion, a particulate portion, and a propellant portion. The particulate portion is made of at least one of urethane foam and melamine foam. With the valve assembly in the closed mode, the product chamber is adapted to contain the base portion, the particulate portion, and the propellant portion such that the propellant portion exists in a gas state and a liquid state and the propellant portion in the gas state pressurizes the base portion, the particulate portion, and the propellant portion in the liquid state. With the valve assembly in the open mode, the propellant portion in the gas state gas state forces at least part of the base portion, the particulate portion, and the propellant portion in the liquid state out of the product chamber and onto the uncoated portion of the substrate to form the repair coat such that the repair coat substantially matches the coated portion of the substrate.

The present invention may also be embodied as a method of applying a repair coat to an uncoated portion of a substrate substantially to match a coated portion of the substrate comprising the following steps. An aerosol assembly comprising a container defining a product chamber and a valve assembly operable in open and closed modes is provided. A base portion, a particulate portion, and a propellant portion are provided. The particulate portion is made of at least one of urethane foam and melamine foam. The base portion, the particulate portion, and the propellant portion are combined to form aerosol material. The aerosol material is arranged within the product chamber such that with the valve assembly in the closed mode, the propellant portion exists in a gas state and a liquid state and the propellant portion in the gas state pressurizes the base portion, the particulate portion, and the propellant portion in the liquid state. With the valve assembly in the open mode, the propellant portion in the gas state gas state forces at least part of the base portion, the particulate portion, and the propellant portion in the liquid state out of the product chamber and onto the uncoated portion of the substrate to form the repair coat such that the repair coat substantially matches the coated portion of the substrate.

The present invention may also be embodied as aerosol material for applying a repair coat to an uncoated portion of a substrate substantially to match a coated portion of the substrate comprising a base portion, a particulate portion, and a propellant portion. The particulate portion made of at least one of urethane foam and melamine foam. When the aerosol material is confined, the propellant portion exists in a gas state and a liquid state, the base portion, the particulate portion, and the propellant portion in the liquid state form a liquid mixture, and the propellant portion in the gas state pressurizes liquid mixture. When the aerosol material is not confined, the propellant portion in the gas state gas state displaces at least part of the liquid mixture onto the uncoated portion of the substrate to form the repair coat such that the repair coat substantially matches the coated portion of the substrate.

DETAILED DESCRIPTION

I. Aerosol Stucco Dispensing Systems

Figure 1:
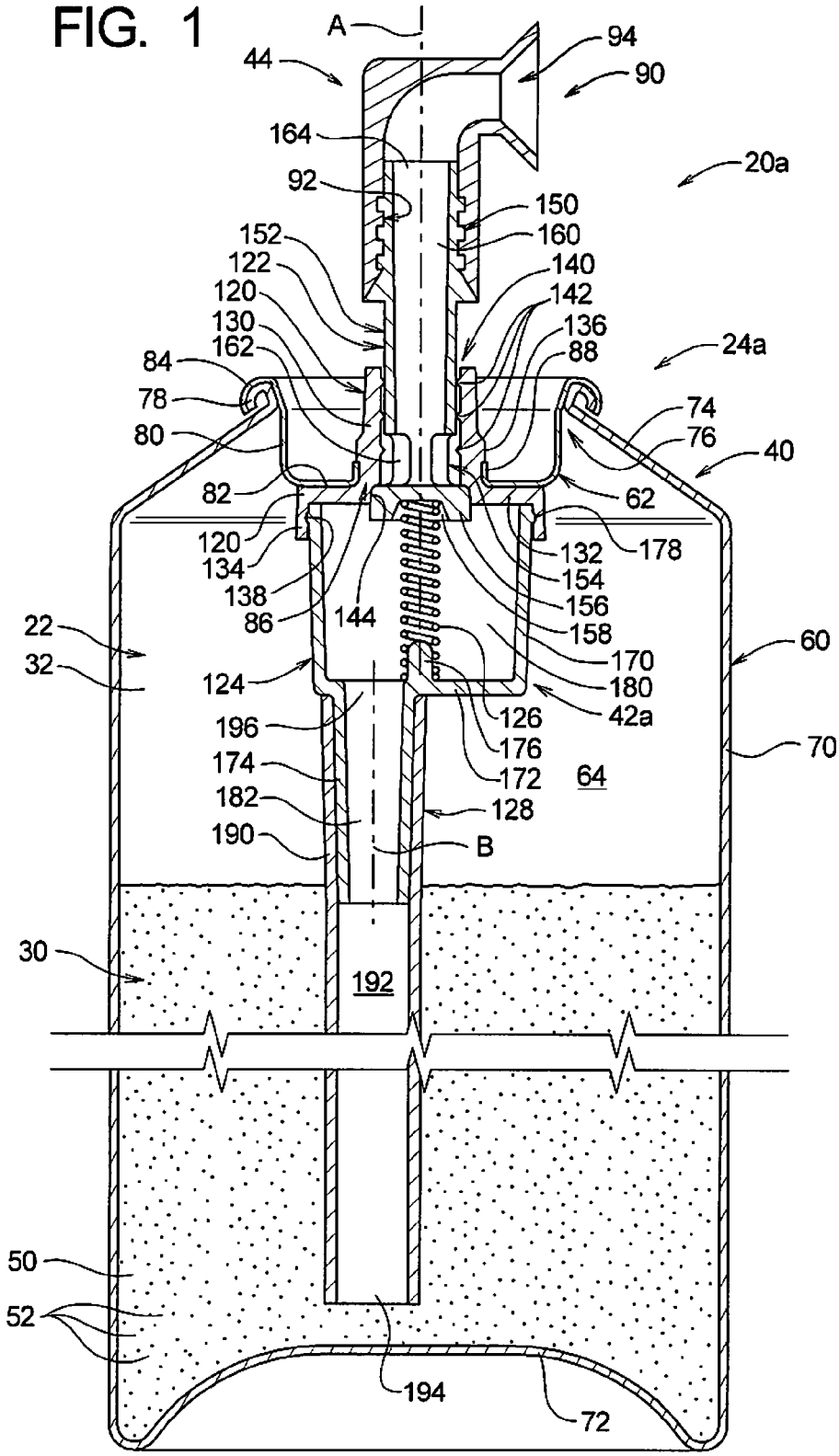
FIG. 1 is a cut-away, side elevation view of a first example mechanical system of the present invention.
Figure 2:
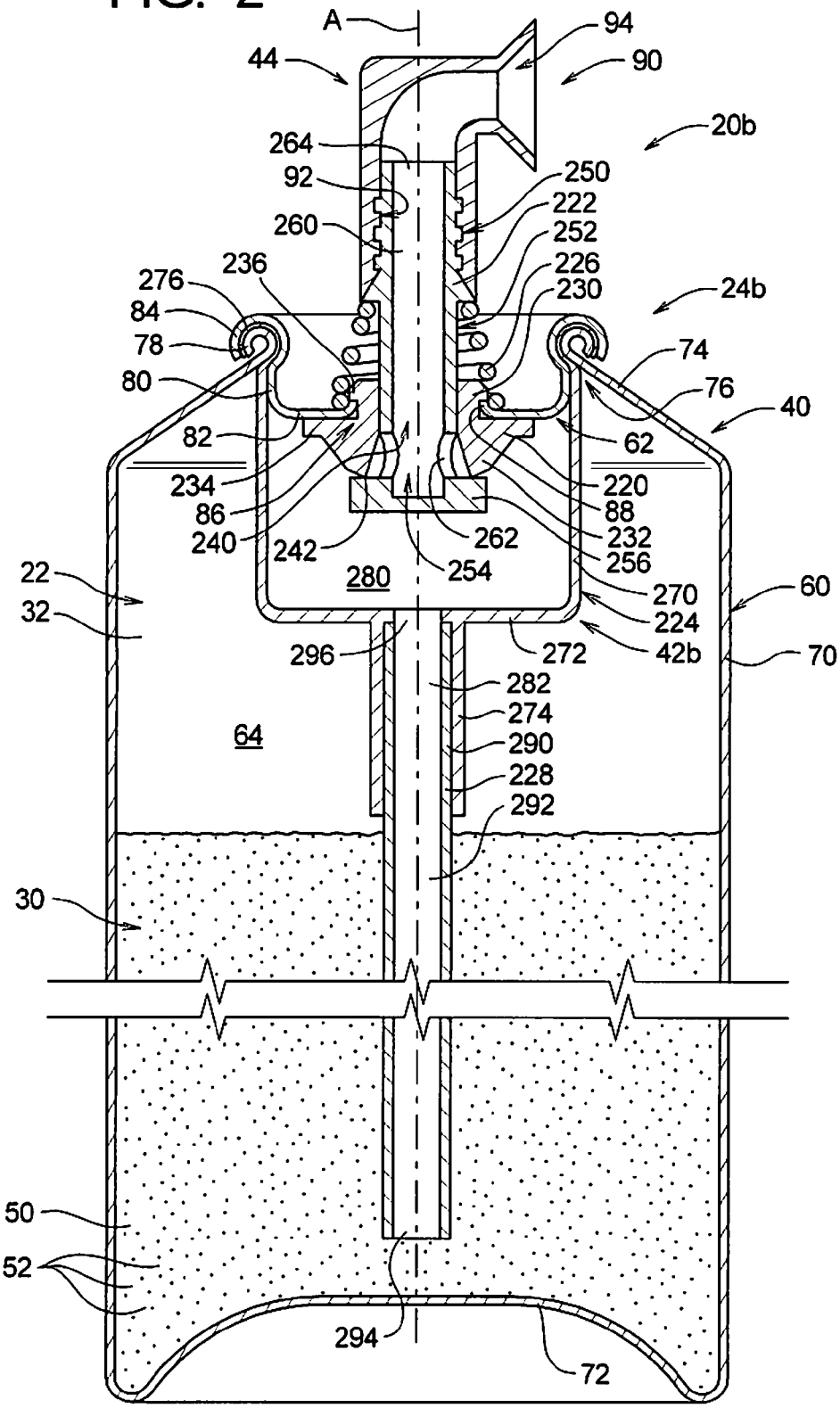
FIG. 2 is a cut-away, side elevation view of a second example mechanical system of the present invention.

Depicted in FIGS. 1 and 2 of the drawing are first and second examples of an aerosol stucco dispensing systems 20*a* and 20*b* constructed in accordance with, and embodying, the principles of the present invention. In the following discussion and the drawing, the appendices "a" and "b" will be used to refer to features unique to the first and second example texturing systems 20*a* and 20*b*, respectively.

The example aerosol stucco dispensing systems 20*a* and 20*b* comprise a fluid system 22 and a mechanical system 24*a*, 24*b*. The fluid system 22 comprises a stucco material 30 to be dispensed and a propellant material 32. The mechanical systems 24*a* and 24*b* comprise a container assembly 440, an actuator 44, and a valve assembly 42*a* and 42*b*, respectively. For clarity in FIGS. 1 and 2, the stucco material 30 is shown only in the container assembly 440; as will be described in further detail below, the texture material will also forced into the valve assembly 42*a*, 42*b* and, in some situations, through and out the actuator 44.

The container assemblies 440 and actuator 44 of the example mechanical systems 24*a* and 24*b* are or may be the substantially the same and will be described only once below. The valve assemblies 42*a* and 42*b* differ and will each be described separately below.

In use, the stucco material 30 and propellant material 32 are stored within the container assembly 440. The propellant material 32 pressurizes the stucco material 30. The valve assembly 42*a*, 42*b* is normally in a closed state, and depressing the actuator 44 causes the valve assembly 42*a*, 42*b* to be placed into an open state. When the valve assembly 42*a*, 42*b* is in the open state, the pressurized propellant material 32 forces the stucco material 30 out of the container assembly 440 and onto a target surface to be coated.

The example stucco material 30 comprises a coating portion 50 and a particulate portion 52. The coating portion 50 exists in a liquid state when stored in the air-tight container assembly 440 but hardens when exposed to the air. The coating portion 50 is not per se important to any particular implementation of the present invention.

The particulate portion 52 is formed by small chips or particles of irregular shape but relatively consistent volume. The example particulate portion 52 is formed by sand, perlite, vermiculite, polypropylene, polyethylene.

As mentioned above, the propellant material 32 must be compatible with the material or materials forming the particulate portion 52 of the stucco material 30. As used herein, the term "compatible" refers to the lack of chemical or biological interaction between the propellant material 32 and the particulate portion 52 that would substantially permanently alter the physical structure or appearance of the particulate portion 52.

Referring now to the composition of the propellant material 32, one or more of the following materials may be used to form the example propellant material 32: di-methyl ethylene (DME); hydrocarbons such as propane and butane and any combinations of propane and butane; compressed air; and compressed nitrogen.

The propellant material 32 used by the example aerosol system 20 is formed by DME. When DME is used as the propellant material 32, the propellant material 32 exists partly in a liquid phase that is mixed with the stucco material 30 and partly in a gas phase that pressurizes the stucco material 30.

As the stucco material 30 is forced out of the container assembly 440, the pressure within the container assembly 440 drops. This pressure drop causes more of the liquid phase propellant material 32 to gasify. Once the actuator 44 is released and the valve assembly 42 returns to its closed state, the gas phase propellant material 32 continues to gasify until the stucco material 30 within the container assembly 440 is again pressurized. The use of DME as the propellant material 32 pressurizes the stucco material 30 at a relatively constant, relatively low level that allows the controlled dispensing of the stucco material 30.

Inert, compressed gasses, such as air or nitrogen, may be used as the propellant material 32. A propellant 32 formed of compressed inert gasses pressurizes the container to force the stucco material 30 out of the container assembly 440. To accommodate expansion of the compressed inert gasses, the system 20 is typically charged to a relatively high initial pressure.

Given the foregoing basic understanding of the example aerosol stucco dispensing systems 20*a* and 20*b*, the details of the systems 20*a* and 20*b* will now be described below in further detail.

A. Coating Portion

The coating portion 50 of the stucco material 30 forming part of the fluid system 22 may be conventional and typically includes the following components: binder such as acrylic polymer, emulsifier such as esther alcohol, filler such as calcium carbonate, water, biocide, fungicide, anti-freeze such as propylene glycol.

B. Container Assembly and Actuator

Referring now to FIGS. 1 and 2, the container assembly 40 and actuator 44 of the example mechanical systems 24*a* and 24*b* will now be described in detail. The example container assemblies 40 each comprises a container 60 and a cap 62. The cap 62 is attached to the container 60 to define a main chamber 64.

The container 60 is a metal body that comprises a side wall 70, lower wall 72, and upper wall 74. The upper wall 74 defines a cap opening 76 and an inner lip 78. The inner lip 78 extends around the cap opening 76. The cap 62 is also a metal body that comprises an extension wall 80, a base wall 82, and an outer lip 84. The base wall 82 defines a mounting opening 86 and a mounting wall 88. The mounting wall 88 extends around the mounting opening 86.

To form the container assembly 40, the outer lip 84 of the cap 62 is arranged over the inner lip 78 of the container 60. The outer lip 84 is crimped such that the outer lip 84 engages, directly or indirectly, the inner lip 78. The resulting container assembly 40 defines a relatively rigid structure. In addition, the outer lip 84 and inner lip 78 engage each other, directly or indirectly, to form a substantially fluid-tight seal; once the container assembly 40 is formed, fluid may flow into and out of the main chamber 64 only through the mounting opening 86. In the example system 20*a*, the outer lip 84 directly engages the inner lip 78. As will be described in further detail below, the outer lip 84 indirectly engages the inner lip 78 in the example system 20*b*.

The container assembly 40 as described is relatively conventional, and container assemblies of different construction may be used in place of the example container assembly 40 depicted in FIGS. 1 and 2.

The example actuator 44 is a plastic body defining an actuator passageway 90. The actuator passageway 90 comprises a threaded portion 92 and an outlet portion 94. As will be described in further detail below, the threaded portion 92 is adapted to engage the valve assemblies 42*a* and 42*b*. The example outlet portion 94 is frustoconical, but other shapes may be used instead or in addition. The example actuator passageway 90 turns along an angle of approximately 90 degrees, but the actuator passageway 90 may be straight or turn along an angle other than 90 degrees.

The actuator 44 as described is also relatively conventional, and actuators of different construction may be used in place of the example actuator 44 depicted in FIGS. 1 and 2.

C. First Example Valve Assembly

Referring now specifically to FIG. 1, the first example valve assembly 42*a* will now be described in further detail. The valve assembly 42*a* comprises a valve seat 120, a valve stem 122, a valve housing 124, a valve spring 126, and a collection tube 128.

The example valve seat 120 comprises a support portion 130, a seat portion 132, and a wall portion 134. Extending from the support portion 130 is a retaining projection 136, and formed in the wall portion 134 is a retaining recess 138. In addition, the valve seat 120 defines a stem opening 140 that extends from the seat portion 132 and through the support portion 130. Extending from the support portion 130 into the stem opening 140 are a plurality of support projections 142. A seat surface 144 is formed in the seat portion 132 around the stem opening 140.

The valve stem 122 comprises a threaded portion 150, a guide portion 152, an inlet portion 154, and a stop portion 156. A spring cavity 158 is formed in the stop portion 156. The valve stem 122 further comprises a stem passageway 160 defining a stem inlet 162 and a stem outlet 164. The stem inlet 162 is formed in the inlet portion 154 of the valve stem 122, and the stem outlet 164 is formed adjacent to the threaded portion 150 of the stem 122.

The valve housing 124 comprises a side wall 170, a bottom wall 172, a tube projection 174, and a spring projection 176. A mounting projection 178 extends from the side wall 170. The valve housing 124 defines a valve chamber 180, and a housing inlet passageway 182 extends through the tube projection 174 to allow fluid to flow into the valve chamber 180.

The housing inlet passageway 182 defines a housing inlet axis B. In the example valve assembly 42, the housing inlet axis B is parallel to and offset from the valve axis A. Other configurations may be used, but offsetting the housing inlet axis B from the valve axis A allows the spring projection 176 to be aligned with the valve axis A. The spring 126 itself thus may be aligned with the valve axis A.

The collection tube 128 comprises a side wall 190 and defines a tube passageway 192. The tube passageway 192 defines a tube inlet 194 and a tube outlet 196.

The valve assembly 42*a* is formed generally as follows. The following assembly steps may be performed in different sequences, and the following discussion does not indicate a preferred or necessary sequence of assembly steps.

The valve stem 122 is arranged such that the guide portion 152 thereof is received within the stem opening 140. The geometry of the example valve stem 122 requires a two-piece construction that would allow the relatively wide threaded portion 150 to be attached to the relatively wide stop portion 156 after the guide portion 152 has been arranged within the stem opening 140. If the threaded portion 150 is relatively narrow and can be inserted through the stem opening 140, the valve stem 122 may be made of a single-piece construction. As another alternative, the threaded portion 150 may be eliminated; in this case, the actuator 44 is secured to the valve stem 122 by other means such as friction and/or the use of an adhesive.

The valve spring 126 is arranged such that one end thereof is retained by the spring projection 176 on the bottom wall 172 of the valve housing 124. The valve housing 124 is displaced until the mounting projection 178 on the housing side wall 170 is received by the retaining recess 138 on the wall portion 134 of the valve seat 120. The other end of the spring 126 is received by the spring cavity 158 in the valve seat 120.

The support projections 142 on the support portion 130 of the valve seat 120 engage the guide portion 152 of the valve stem 122 to restrict movement of the valve stem 122 within a predetermined range along a valve axis A. The valve spring 126 resiliently opposes movement of the valve stem 122 towards the bottom wall 172 of the valve housing 124.

The valve seat 120 is displaced such that the support portion 130 extends through the mounting opening 86 in the cap 62. Further displacement of the valve seat 120 forces the retaining projection 136 on the valve seat 120 past the mounting wall 88 on the cap 62. The retaining projection 136 engages the mounting wall 88 to mechanically attach the valve seat 120 onto the cap 62. The overlap of the mounting wall 88 and base wall 82 with the valve seat 120 forms a substantially fluid-tight seal around the mounting opening 86.

The collection tube 128 is secured to the valve housing 124 by inserting the tube 128 into the housing inlet passageway 182 or, as shown in FIG. 1, inserting the tube projection 174 into the tube passageway 192.

The actuator 44 is attached to the valve stem 122. In particular, in the example mechanical system 24*a*, the threaded portions 92 and 150 engage each other to detachably attach the actuator 44 to the valve stem 122. As generally discussed above, other attachment systems may be used to attach the actuator 44 to the valve stem 122.

The valve assembly 42*a* operates basically as follows. The valve spring 126 biases the valve stem 122 into an extended position as shown in FIG. 1. When the valve stem 122 is in the extended position, the stop portion 156 thereof engages the seat surface 144 formed on the valve seat 120. The example seat surface 144 is annular and curved. The stop portion 156 is sized and configured to conform to the shape of the seat surface 144.

Accordingly, when the stop portion 156 of the valve stem engages the seat surface 144, fluid flow between the valve chamber 180 and the stem passageway 160 is substantially prevented, and the valve assembly 42*a* is in its closed position. However, by applying a force on the actuator 44 sufficient to compress the valve spring 126, the stop portion 156 is displaced away from the seat surface 144 to place the valve assembly 42*a* into its open configuration. When the valve assembly 42*a* is in its open configuration, fluid may flow between the valve chamber 180 and the stem passageway 160.

When fitted with the first example valve assembly 42*a*, the aerosol stucco dispensing system 20*a* is used to dispense stucco material 30 as follows. The actuator 44 is aimed towards a target surface and depressed towards the cap member 62 to place the valve assembly 42*a* in its open configuration. The propellant material 32 forces the stucco material 30 through the tube inlet 194, the tube passageway 192, the tube outlet 196, and the housing inlet 182 and into the valve chamber 180.

From the valve chamber 180, the stucco material 30 flows between the stop portion 156 and the seat surface 144 and into the stem inlet 162. The stucco material 30 then flows through the stem passageway 160 and out of the stem outlet 164. The stucco material 30 then flows along the actuator passageway 90 and out of the outlet portion 94 thereof. The stucco material 30 discharged through the outlet portion 94 forms a spray and ultimately lands on the target surface.

When sufficient stucco material 30 has been deposited onto the target surface, the force on the actuator 44 is released. The valve spring 126 displaces the valve stem 122 to place the valve assembly 42*a* back into its closed configuration. The stucco material 30 thus no longer flows out of the valve chamber 180 through the stem passageway 160.

D. Second Example Valve Assembly

Referring now specifically to FIG. 2, the second example valve assembly 42*b* will now be described in further detail. The valve assembly 42*b* comprises a valve seat 220, a valve stem 222, a valve housing 224, a valve spring 226, and a collection tube 228.

The example valve seat 220 comprises a support portion 230, a seat portion 232, and a wall portion 234. Extending from the support portion 230 is a retaining projection 236. In addition, the valve seat 220 defines a stem opening 240 that extends from the seat portion 232 and through the support portion 230. A seat edge 242 is formed in the seat portion 232 around the stem opening 240.

The valve stem 222 comprises a threaded portion 250, a guide portion 252, an inlet portion 254, and a stop portion 256. The valve stem 222 further comprises a stem passageway 260 defining a stem inlet 262 and a stem outlet 264. The stem inlet 262 is formed in the inlet portion 254 of the valve stem 222, and the stem outlet 264 is formed adjacent to the threaded portion 250 of the stem 222.

The valve housing 224 comprises a side wall 270, a bottom wall 272, and a tube projection 274. A mounting portion 276 extends from the side wall 270. The valve housing 224 defines a valve chamber 280, and a housing inlet passageway 282 extends through the tube projection 274 to allow fluid to flow into the valve chamber 280.

The collection tube 228 comprises a side wall 290 and defines a tube passageway 292. The tube passageway 292 defines a tube inlet 294 and a tube outlet 296.

The valve assembly 42*b* is formed generally as follows. The following assembly steps may be performed in different sequences, and the following discussion does not indicate a preferred or necessary sequence of assembly steps.

The valve stem 222 is arranged such that the guide portion 252 thereof is received within the stem opening 240. The geometry of the example valve stem 222 requires a two-piece construction that would allow the relatively wide threaded portion 250 to be attached to the relatively wide stop portion 256 after the guide portion 252 has been arranged within the stem opening 240. If the threaded portion 250 is relatively narrow and can be inserted through the stem opening 240, the valve stem 222 may be made of a single-piece construction. As another alternative, the threaded portion 250 may be eliminated; in this case, the actuator 44 is secured to the valve stem 222 by other means such as friction and/or the use of an adhesive.

The valve spring 226 is arranged such that one end thereof is supported by the base wall 82 of the cap 62. The other end of the spring 226 is arranged below the actuator 44 such that depressing the actuator 44 towards the container assembly 40 compresses the spring 226.

The support portion 230 of the valve seat 220 engages the guide portion 252 of the valve stem 222 to restrict movement of the valve stem 222 within a predetermined range along a valve axis A. The valve spring 226 resiliently opposes movement of the valve stem 222 towards the bottom wall 272 of the valve housing 224.

The valve seat 220 is displaced such that the support portion 230 extends through the mounting opening 86 in the cap 62. Further displacement of the valve seat 220 forces the retaining projection 236 on the valve seat 220 past the mounting wall 88 on the cap 62. The retaining projection 236 engages the mounting wall 88 to mechanically attach the valve seat 220 onto the cap 62. The overlap of the mounting wall 88 and base wall 82 with the valve seat 220 forms a substantially fluid-tight seal around the mounting opening 86.

The collection tube 228 is secured to the valve housing 224 by inserting the tube projection 274 into the tube passageway 292 or, as shown in FIG. 2, inserting the collection tube 228 at least partly into the housing inlet passageway 282.

The actuator 44 is attached to the valve stem 222. In particular, in the example mechanical system 24*b*, the threaded portions 92 and 250 engage each other to detachably attach the actuator 44 to the valve stem 222. As generally discussed above, other attachment systems may be used to attach the actuator 44 to the valve stem 222.

The valve assembly 42*b* operates basically as follows. The valve spring 226 biases the valve stem 222 into an extended position as shown in FIG. 2. When the valve stem 222 is in the extended position, the stop portion 256 thereof engages the seat edge 242 formed on the valve seat 220. When the stop portion 256 of the valve stem engages the seat edge 242, fluid flow between the valve chamber 280 and the stem passageway 260 is substantially prevented, and the valve assembly 42*b* is in its closed position.

However, by applying a force on the actuator 44 sufficient to compress the valve spring 226, the stop portion 256 is displaced away from the seat edge 242 to place the valve assembly 42*b* into its open configuration. When the valve assembly 42*b* is in its open configuration, fluid may flow between the housing chamber 280 and the stem passageway 260.

When fitted with the first example valve assembly 42*b*, the aerosol stucco dispensing system 20*b* is used to dispense stucco material 30 as follows. The actuator 44 is aimed towards a target surface and depressed towards the cap member 62 to place the valve assembly 42*b* in its open configuration. The propellant material 32 forces the stucco material 30 through the tube inlet 294, the tube passageway 292, the tube outlet 296, and the housing inlet 282 and into the housing chamber 280.

From the valve chamber 280, the stucco material 30 flows between the stop portion 256 and the seat edge 242 and into the stem inlet 262. The stucco material 30 then flows through the stem passageway 260 and out of the stem outlet 264. The stucco material 30 then flows along the actuator passageway 90 and out of the outlet portion 94 thereof. The stucco material 30 discharged through the outlet portion 94 forms a spray and ultimately lands on the target surface.

When sufficient stucco material 30 has been deposited onto the target surface, the force on the actuator 44 is released. The valve spring 226 displaces the valve stem 222 to place the valve assembly 42*b* back into its closed configuration. The stucco material 30 thus no longer flows out of the valve chamber 280 through the stem passageway 260.

E. Method of Use

Figure 3:
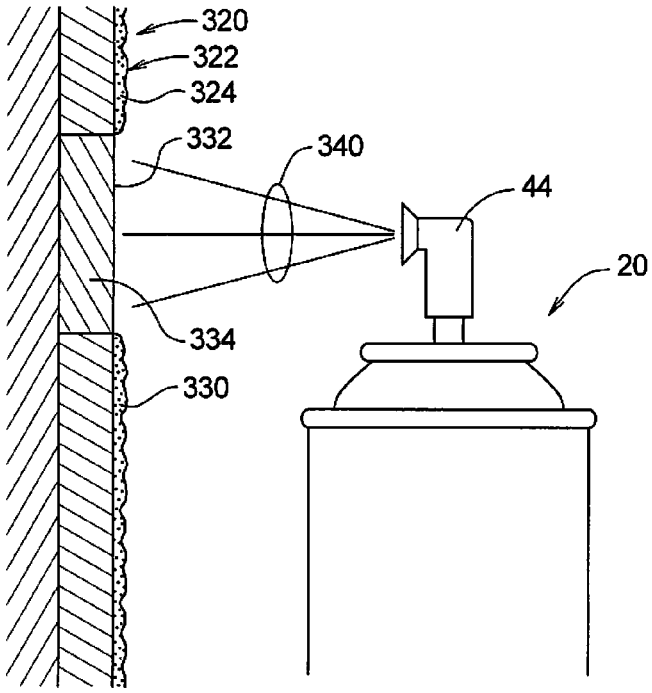
FIGS. 3 and 4 are side elevation partial cut-away views depicting a method of use of the example dispensing systems of the present invention.
Figure 4:
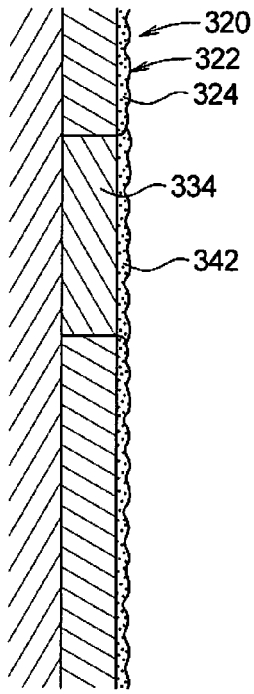

Referring now to FIGS. 3-6, the method of using the example aerosol stucco dispensing systems 20*a* and 20*b* will now be described in further detail. In FIG. 3, reference character 20 is used to refer to either of the dispensing systems 20*a* and 20*b* as described above.

Figure 5:
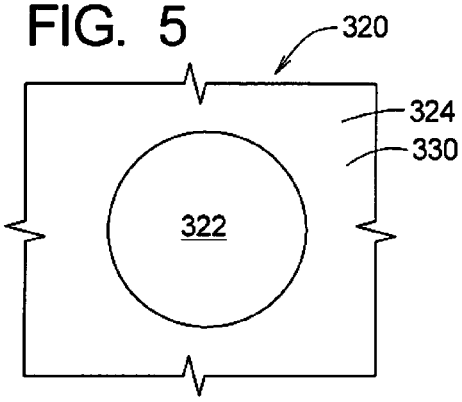
FIGS. 5 and 6 are front plan views depicting a portion of a wall structure under repair using the example dispensing systems of the present invention.

As shown in FIGS. 3 and 5, a wall structure 320 defines a wall surface 322 at least partly coated with a layer of pre-existing stucco material 324. The example wall surface 322 defines a coated portion 330 and an uncoated portion 332. The uncoated portion 332 may be formed where a patch 334 has been made in the wall structure, but the dispensing system 20 of the present invention can be used to dispense stucco material 30 in other environments.

The dispensing system 20 is arranged such that the outlet portion 94 of the actuator passageway 90 defined by the actuator 44 is generally directed towards the uncoated portion 320 as shown in FIG. 3. The actuator 44 is then depressed to cause the dispensing system 20 to dispense the stucco material 30 in a spray 340. The stucco material 30 is then allowed to dry and harden.

Figure 6:
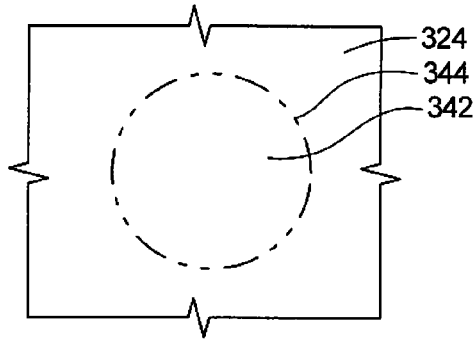

The spray 340 causes the stucco material 30 to be deposited onto the uncoated portion 332 in a thin layer 342 (FIG. 4) that substantially matches the pre-existing layer 324. A broken line 344 in FIG. 6 illustrates where the uncoated portion 332 was located prior to application of the stucco material 30.

II. Aerosol Acoustic Texture Dispensing Systems

Figure 7:
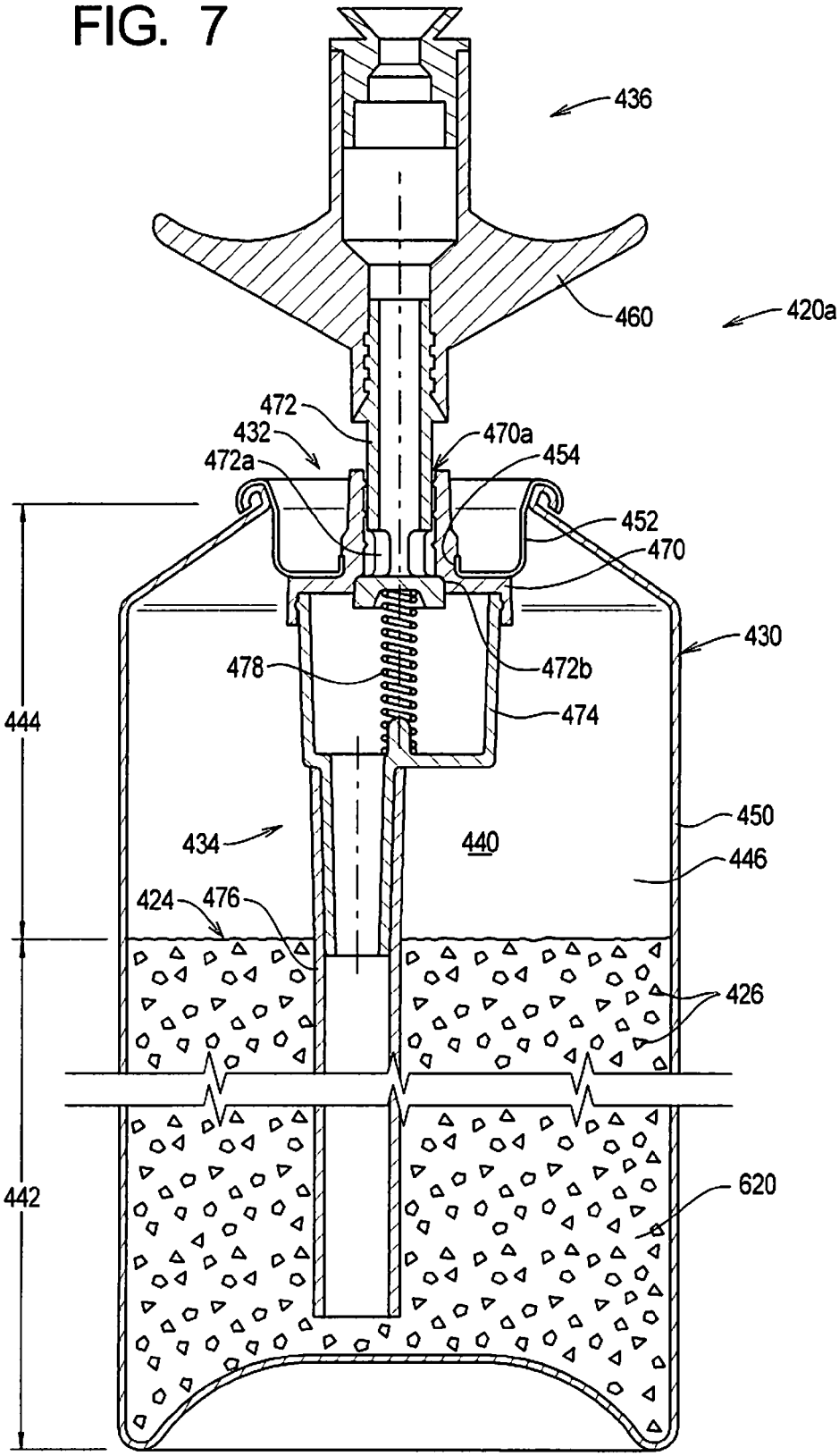
FIG. 7 is a section view of a first embodiment of an aerosol dispensing system containing acoustic texture material incorporating particulate material of the present invention.
Figure 8:
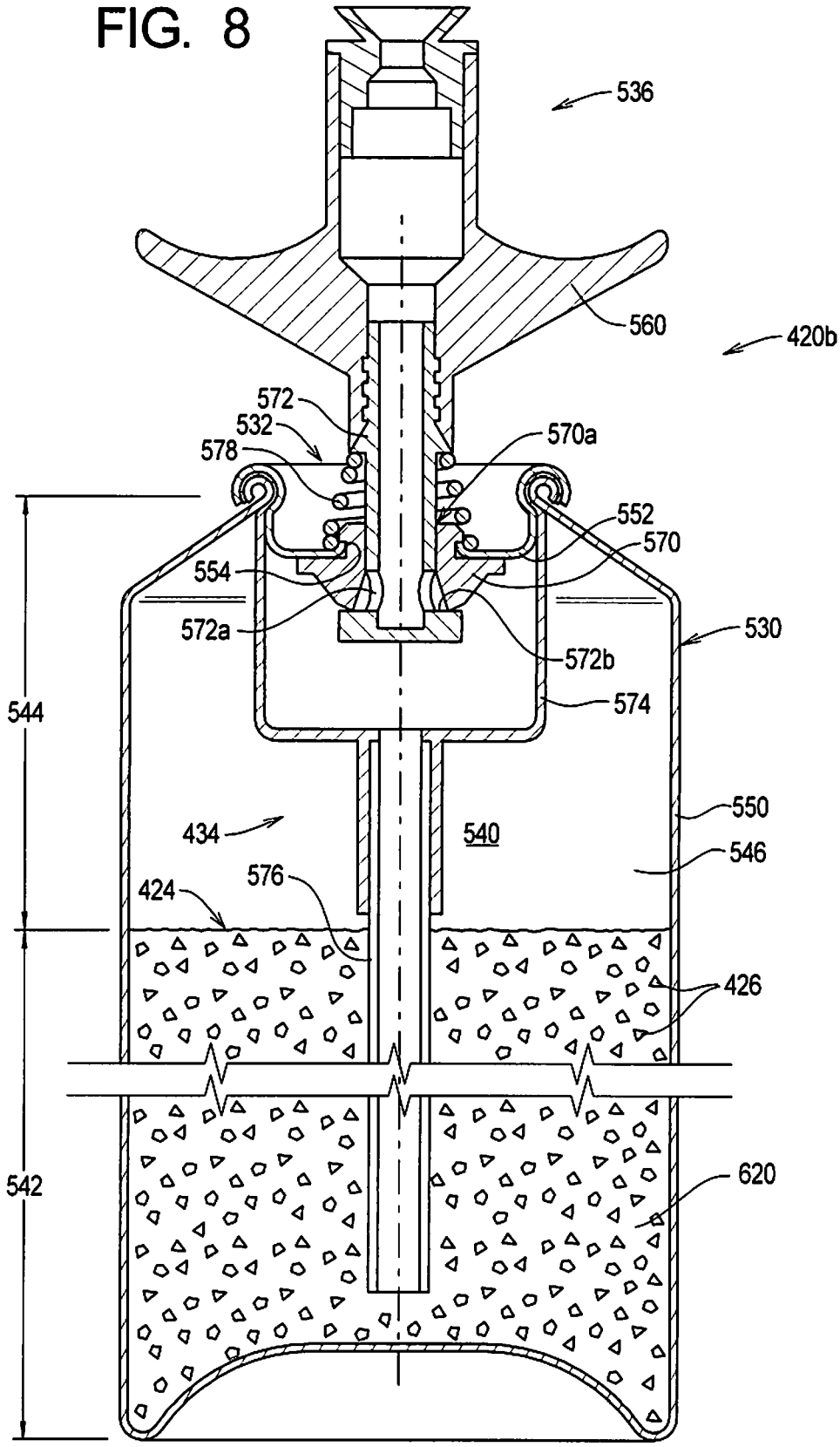
FIG. 8 is a section view of a second embodiment of an aerosol dispensing system containing acoustic texture material incorporating particulate material of the present invention.

Depicted in FIGS. 7 and 8 of the drawing are first and second examples of an aerosol acoustic texture dispensing systems 420*a* and 420*b* constructed in accordance with, and embodying, the principles of the present invention.

A. First Example

Figure 10:
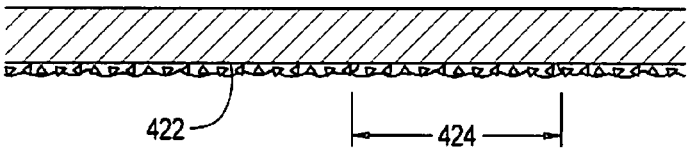
FIG. 10 is a section view of the acoustic texture material after it has been deposited on the surface.
Figure 11:
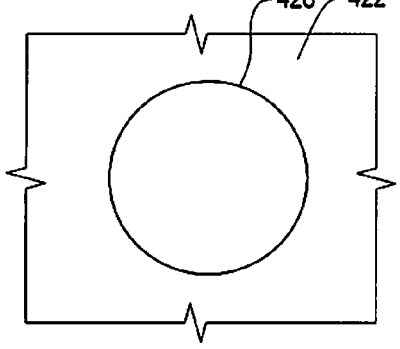
FIGS. 11 and 12 are bottom plan views of the surface before and after the acoustic texture material has been deposited thereon.

Referring now to FIG. 7 of the drawing, depicted at 420*a* therein is a first embodiment of an aerosol system for depositing on a surface 422 (FIGS. 9-12) acoustic texture material 424 incorporating particulate material 426 of the present invention. FIG. 11 illustrates a target portion 428 of the surface 422 on which acoustic texture material 424 is to be deposited.

The example aerosol system 420*a* comprises a container assembly 430, a valve assembly 432, a collection assembly 434, and an outlet assembly 436. The container 430 defines a product chamber 440 in which the acoustic texture material 424 comprising the particulate material 426 is contained. A first portion 442 of the chamber 440 is occupied by the acoustic texture material 424, while a second portion 444 of the chamber 440 is occupied by a pressurized propellant material 446. The example container assembly 430 comprises a can member 450 and a cup member 452.

The valve assembly 432 is mounted in a cup opening 454 defined by the cup member 452 and operates in a closed configuration (shown) and an open configuration. In the open configuration, the valve assembly 432 defines a dispensing passageway that allows fluid communication between the interior and the exterior of the container assembly 430.

The outlet assembly 436 comprises an actuator member 460 that causes acoustic texture material 424 to be dispensed by the system 420 in a fan shaped spray as will be described in further detail below. The actuator member 460 is mounted on the valve assembly 432 such that displacing the to actuator member 460 towards the valve assembly 432 places the valve assembly in the open configuration.

The example valve assembly 432 comprises a valve seat 470, a valve stem 472, a valve housing 474, a dip tube 476, and a valve spring 478. The valve seat 470 defines a seat opening 470*a* and is supported by the cup member 452. The valve stem 472 defines a valve stem opening 472*a* and a valve surface 472*b*. The valve stem 472 is supported by the valve seat 470 such that the valve stem moves within the valve stem opening 472*a* between first and second positions, with the first position being shown in FIG. 7.

The valve housing 474 is supported by the valve seat 470 within the product chamber 440. The valve housing 474 further supports the dip tube 476 such that the acoustic texture material 424 within can flow into the valve housing 474 when the can is upright. The valve spring 478 is supported by the valve housing 474 such that the spring 478 biases the valve stem 472 into the first position. The valve stem 472 supports the outlet assembly 436 such that depressing the actuator member 460 towards the cup member 452 forces the valve stem 472 into the second position (not shown) against the force of the valve spring 478.

The valve assembly 432 thus operates in the closed configuration and the open configuration as follows. When no force is applied to the actuator member 460, the valve spring 478 forces the valve surface 472*b* against the valve seat 470 to prevent fluid from flowing through the valve stem opening 472*a*. When a force is applied to the actuator member 460, the valve surface 472*b* is forced away from the valve seat 470 such that fluid can flow from the interior of the valve housing 474 through the valve stem opening 472*a* and thus out of the product chamber 440.

B. Second Example

Referring now to FIG. 8 of the drawing, depicted at 420*b* therein is a first embodiment of an aerosol system that may also be used to deposit the acoustic texture material 424 incorporating particulate material 426 of the present invention on the target portion 428 of the surface 422.

The example aerosol system 420*b* comprises a container assembly 530, a valve assembly 532, a collection assembly 534, and an outlet assembly 536. The container 530 defines a product chamber 540 in which the acoustic texture material 424 comprising the particulate material 426 is contained. A first portion 542 of the chamber 540 is occupied by the acoustic texture material 424, while a second portion 544 of the chamber 540 is occupied by a pressurized propellant material 546. The example container assembly 530 comprises a can member 550 and a cup member 552.

The valve assembly 532 is mounted in a cup opening 554 define by the cup member 552 and operates in a closed configuration (shown) and an open configuration. In the open configuration, the valve assembly 532 defines a dispensing passageway that allows fluid communication between the interior and the exterior of the container assembly 530.

The outlet assembly 536 comprises an actuator member 560 that causes acoustic texture material 424 to be dispensed by the system 420 in a fan shaped spray as will be described in further detail below. The actuator member 560 is mounted on the valve assembly 532 such that displacing the actuator member 560 towards the valve assembly 532 places the valve assembly in the open configuration.

The example valve assembly 532 comprises a valve seat 570, a valve stem 572, a valve housing 574, a dip tube 576, and a valve spring 578. The valve seat 570 defines a seat opening 570*a* and is supported by the cup member 552. The valve stem 572 defines a valve stem opening 572*a* and a valve surface 572*b*. The valve stem 572 is supported by the valve seat 570 such that the valve stem moves within the valve stem opening 572*a* between first and second positions, with the first position being shown in FIG. 8.

The valve housing 574 is supported by the valve seat 570 within the product chamber 540. The valve housing 574 further supports the dip tube 576 such that the acoustic texture material 424 within can flow into the valve housing 574 when the can is upright. The valve spring 578 is supported by the valve housing 574 such that the spring 578 biases the valve stem 572 into the first position. The valve stem 572 supports the outlet assembly 536 such that depressing the actuator member 560 towards the cup member 552 forces the valve stem 572 into the second position (not shown) against the force of the valve spring 578.

The valve assembly 532 thus operates in the closed configuration and the open configuration as follows. When no force is applied to the actuator member 560, the valve spring 578 forces the valve surface 572*b* against the valve seat 570 to prevent fluid from flowing through the valve stem opening 572*a*. When a force is applied to the actuator member 560, the valve surface 572*b* is forced away from the valve seat 570 such that fluid can flow from the interior of the valve housing 574 through the valve stem opening 572*a* and thus out of the product chamber 540.

C. Method of Use

Turning now to FIGS. 9-12, the use of the aerosol dispensing systems 420*a* and 420*b* will now be described in further detail. These dispensing systems 420*a* and 420*b* are used in the same manner and are both identified by reference character 420 in FIGS. 9-12.

Figure 9:
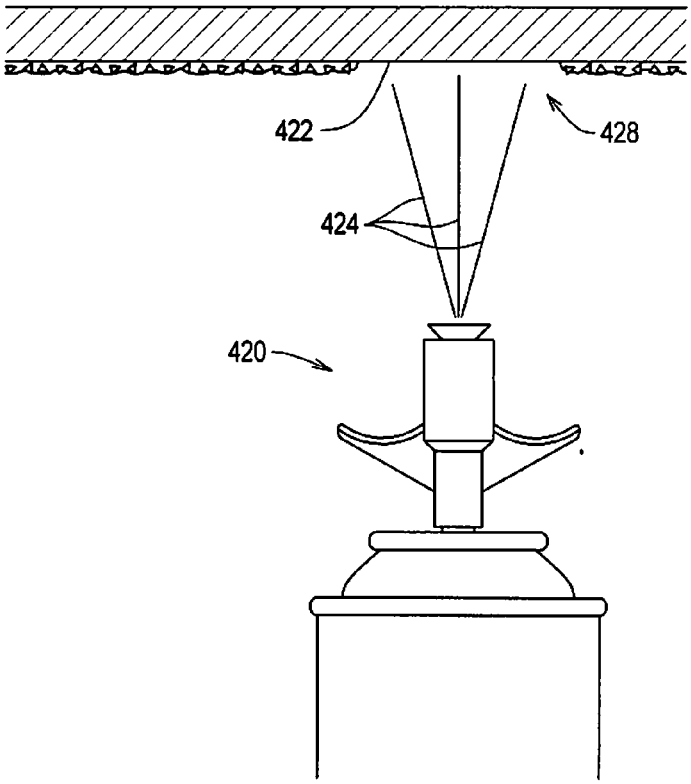
FIG. 9 is an elevation view depicting the use of one or both of the first and second aerosol dispensing systems of FIGS. 7 and 8 being used to deposit acoustic texture material to a surface.
Figure 12:
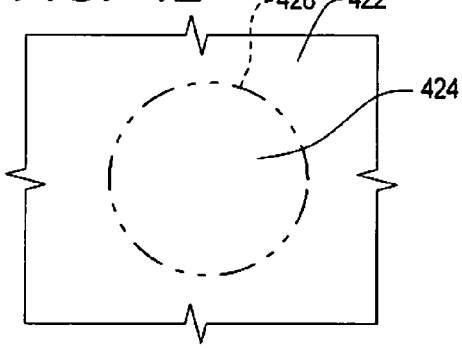

As shown in FIG. 9, the dispensing system 420 deposits a fan-shaped spray of acoustic texture material 424 on the target portion 428 of the surface 422. As shown in FIGS. 10 and 12, the acoustic texture material 424 covers the target portion 428 to match the pre-existing acoustic texture material on the surface 422 surrounding the target portion 428.

Referring for a moment back to FIGS. 7 and 8, it can be seen that, in addition to the particulate material 426, the acoustic texture material comprises a base portion 620 in the form of a flowable liquid. The base portion 620 of the particulate material conventionally comprises a carrier, a filler, and a binder.

In some aerosol systems, the propellant material 446,546 is simply an inert pressurized gas such as air or nitrogen. In other aerosol systems, the propellant material 446,546 is a material, referred to herein as bi-phase propellant material, that exists in both gaseous and liquid phases within the container assembly 430,530. The liquid phase of the propellant material 446,546 forms a part of the base portion 620, while the gaseous phase propellant material 446,546 occupies the pressurized portion 444 of the container assembly 430,530.

As the acoustic texture material 424 is dispensed, the pressure within the pressurized portion 444,544 of the container assemblies 430,530 drops. Under these conditions, a portion of the bi-phase propellant material 446,546 in the liquid phase gasifies to re-pressurize the pressurized portion 444,544 of the container assembly 430,530. The pressure within the pressurized portion 444,544 is thus under most conditions sufficient to force the acoustic texture material 424 out of the container assembly 430,530 along the dispensing passageway when the valve assembly 432,532 is in the open configuration. The propellant material 446,546 may thus be a pressurized inert gas such as air or nitrogen.

However, the present invention is of particular significance when the propellant material is a bi-phase propellant material such as di-methyl ethylene (DME) or any one of a number of hydrocarbon propellants such as those available in the industry as A-40 and A-70. The advantage of using bi-phase propellant materials is that the pressure within the pressurized portion 444,544 of the container assembly 430,530 is kept at a relatively constant, relatively low level as the level of acoustic texture material 424 drops. This constant, low level pressure allows the texture material 424 to be dispensed in many small bursts instead of in a few large bursts, as is the case when pressurized inert gases are used as the propellant material 446,546.

Many particulate materials 426 suitable for use in acoustic texture materials are incompatible with bi-phase propellant materials. For example, as described above polystyrene chips are commonly used in acoustic texture materials dispensed using commercial hopper guns. However, polystyrene chips dissolve in the bi-phase propellant materials of which the Applicant is aware.

The Applicant has discovered that urethane foam materials and melamine foam materials may be used as the particulate material 426 with bi-phase propellant materials such as DME and hydrocarbon propellants such as A-40 and A-70. Melamine foam materials in particular are easily chopped up using conventional material processors (e.g., a food blender) into irregular shapes that match the appearance and function of polystyrene chips. Melamine foam materials are already commonly used in building applications and have desirable fire retardant, thermal, and acoustic properties.

To manufacture the acoustic texture material 424, the base portion 620 may be the same as a conventional base used in commercially available acoustic texture materials. Instead of polystyrene chips, however, urethane and/or melamine foam is chopped up into particles of an appropriate size and use as the particulate. In addition, a bi-phase propellant material is used to form part of the carrier portion of the base portion 620.

The Applicant has thus determined that a conventional base portion using melamine foam chips and DME as a propellant is commercially practical and obtains acceptable aesthetic and functional results. Appropriate adjustments in the liquids used as the carrier in a conventional acoustic texture material formulation may be required to obtain a desired consistency of the acoustic texture material 424 as it is deposited on the surface 422.

Various modifications can be made to the embodiments described above without departing from the principles of the present invention.

What is claimed is:

1. Aerosol material for applying a repair coat to an uncoated portion of a substrate substantially to match a coated portion of the substrate using an aerosol assembly comprising a container defining a product chamber and a valve assembly operable in open and closed modes, the aerosol material comprising:

a base portion;

a particulate portion made of at least one of urethane foam and melamine foam; and a propellant portion; whereby with the valve assembly in the closed mode, the product chamber is adapted to contain the base portion, the particulate portion, and the propellant portion such that the propellant portion exists in a gas state and a liquid state, and the propellant portion in the gas state pressurizes the base portion, the particulate portion, and the propellant portion in the liquid state; and with the valve assembly in the open mode, the propellant portion in the gas state gas state forces at least part of the base portion, the particulate portion, and the propellant portion in the liquid state out of the product chamber and onto the uncoated portion of the substrate to form the repair coat such that the repair coat substantially matches the coated portion of the substrate.

2. Aerosol material as recited in claim 1, in which the propellant portion comprises a hydrocarbon propellant.

3. Aerosol material as recited in claim 1, in which the propellant portion comprises DME.

4. Aerosol material as recited in claim 1, in which the propellant portion comprises A-40.

5. Aerosol material as recited in claim 1, in which the propellant portion comprises A-70.

6. A method of applying a repair coat to an uncoated portion of a substrate substantially to match a coated portion of the substrate, the method comprising the steps of:

providing an aerosol assembly comprising a container defining a product chamber and a valve assembly operable in open and closed modes;

providing a base portion;

providing a particulate portion made of at least one of urethane foam and melamine foam;

providing a propellant portion;

combining the base portion, the particulate portion, and the propellant portion to form aerosol material;

arranging the aerosol material within the product chamber such that with the valve assembly in the closed mode, the propellant portion exists in a gas state and a liquid state, and the propellant portion in the gas state pressurizes the base portion, the particulate portion, and the propellant portion in the liquid state; and with the valve assembly in the open mode, the propellant portion in the gas state gas state forces at least part of the base portion, the particulate portion, and the propellant portion in the liquid state out of the product chamber and onto the uncoated portion of the substrate to form the repair coat such that the repair coat substantially matches the coated portion of the substrate.

7. A method as recited in claim 6, in which the propellant portion comprises a hydrocarbon propellant.

8. A method as recited in claim 6, in which the propellant portion comprises DME.

9. A method as recited in claim 6, in which the propellant portion comprises A-40.

10. A method as recited in claim 6, in which the propellant portion comprises A-70.

11. Aerosol material for applying a repair coat to an uncoated portion of a substrate substantially to match a coated portion of the substrate comprising:

a base portion;

a particulate portion made of at least one of urethane foam and melamine foam; and a propellant portion; whereby when the aerosol material is confined, the propellant portion exists in a gas state and a liquid state, the base portion, the particulate portion, and the propellant portion in the liquid state form a liquid mixture, and the propellant portion in the gas state pressurizes liquid mixture; and when the aerosol material is not confined, the propellant portion in the gas state gas state displaces at least part of the liquid mixture onto the uncoated portion of the substrate to form the repair coat such that the repair coat substantially matches the coated portion of the substrate.

12. Aerosol material as recited in claim 11, in which the propellant portion comprises a hydrocarbon propellant.

13. Aerosol material as recited in claim 11, in which the propellant portion comprises DME.

14. Aerosol material as recited in claim 11, in which the propellant portion comprises A-40.

15. Aerosol material as recited in claim 11, in which the propellant portion comprises A-70.

* * * * *